US010235949B2

(12) United States Patent
Sohn et al.

(10) Patent No.: US 10,235,949 B2
(45) Date of Patent: Mar. 19, 2019

(54) TIMING CONTROLLER, DISPLAY APPARATUS HAVING THE SAME AND METHOD OF DRIVING THE DISPLAY APPARATUS

(71) Applicant: SAMSUNG DISPLAY CO., LTD., Yongin-si, Gyeonggi-Do (KR)

(72) Inventors: Young-Soo Sohn, Guri-si (KR); Jae Hyoung Park, Suwon-si (KR); Ok-Kwon Shin, Seoul (KR); Jong-Jae Lee, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 149 days.

(21) Appl. No.: 15/096,935

(22) Filed: Apr. 12, 2016

(65) Prior Publication Data

US 2017/0092207 A1 Mar. 30, 2017

(30) Foreign Application Priority Data

Sep. 30, 2015 (KR) ..... 10-2015-0137408

(51) Int. Cl.
*G09G 3/36* (2006.01)

(52) U.S. Cl.
CPC ..... *G09G 3/3607* (2013.01); *G09G 3/3685* (2013.01); *G09G 3/3696* (2013.01);
(Continued)

(58) Field of Classification Search
CPC .. G09G 3/3607; G09G 3/3685; G09G 3/3696; G09G 2320/0673;
(Continued)

(56) References Cited

U.S. PATENT DOCUMENTS 6,335,719 B1 * 1/2002 An ..... G09G 3/3614 345/96
7,965,286 B2 * 6/2011 Ryu ..... G09G 3/3614 345/209

(Continued)

FOREIGN PATENT DOCUMENTS

KR 1020080105701 12/2008
KR 1020090061466 6/2009
KR 1020110130706 12/2011

*Primary Examiner* — Grant Sitta
(74) *Attorney, Agent, or Firm* — F. Chau & Associates, LLC

(57) ABSTRACT

A timing controller includes a data grouping part that generates a plurality of grayscale groups based on input image data, each grayscale group including n×m grayscales, a grayscale classifying part that generates a plurality of grayscale patterns respectively corresponding to the grayscale groups, a grayscale in the grayscale groups being classified in the grayscale patterns as a first grayscale if the grayscale is higher than a first reference grayscale or as a second grayscale if the grayscale is lower than a second reference grayscale, a pattern comparing part that compares each grayscale pattern with a first pattern including the n×m first and second grayscales, a pattern counter that counts a number of patterns of the grayscale patterns that are substantially the same as the first pattern, and a driving mode changing part that changes a driving mode of a display panel when the number is greater than a reference number.

17 Claims, 12 Drawing Sheets

(52) U.S. Cl.
CPC ..... *G09G 2300/0452* (2013.01); *G09G 2310/027* (2013.01); *G09G 2310/08* (2013.01); *G09G 2320/0242* (2013.01); *G09G 2320/0673* (2013.01)

(58) Field of Classification Search
CPC ..... G09G 2310/027; G09G 2310/08; G09G 2320/0242; G09G 2300/0452; G09G 3/3208; G09G 3/003; G09G 2380/12; G09G 2320/10; G02B 27/017; G02B 27/01; G02B 2027/0118; H01L 27/32; G02F 1/13306; G02F 2203/12; G02F 2201/44; G02F 2001/133601; G02F 1/141
See application file for complete search history.

(56) References Cited

U.S. PATENT DOCUMENTS 8,044,948 B2 10/2011 Lee
8,319,717 B2 * 11/2012 Kim ..... G09G 3/3614 345/209
8,970,564 B2 * 3/2015 Moon ..... G09G 3/3648 345/204
2001/0004253 A1 * 6/2001 Fukutoku ..... G09G 3/3614 345/96
2002/0130830 A1 * 9/2002 Park ..... G09G 3/3406 345/99
2005/0001829 A1 * 1/2005 Bu ..... G09G 3/3648 345/209
2006/0097967 A1 * 5/2006 Lee ..... G09G 3/3614 345/87
2007/0001963 A1 * 1/2007 Koma ..... G09G 3/3614 345/96
2008/0204444 A1 * 8/2008 Ryu ..... G09G 3/3614 345/214
2015/0348489 A1 * 12/2015 Kabe ..... G09G 3/3696 345/206
2015/0355766 A1 * 12/2015 Kotani ..... G06F 3/0412 345/173

* cited by examiner

FIG. 4

M11

| R | G | B | R | G | B |
|---|---|---|---|---|---|
| 255 | 40 | 220 | 0 | 205 | 15 |
| 230 | 10 | 255 | 20 | 205 | 0 |

M12

| R | G | B | R | G | B |
|---|---|---|---|---|---|
| 255 | 250 | 190 | 55 | 0 | 30 |
| 190 | 210 | 255 | 70 | 60 | 0 |

FIG. 5

PM1

| R | G | B | R | G | B |
|---|---|---|---|---|---|
| 1 | 0 | 1 | 0 | 1 | 0 |
| 1 | 0 | 1 | 0 | 1 | 0 |

PM2

| R | G | B | R | G | B |
|---|---|---|---|---|---|
| 1 | 1 | 1 | 0 | 0 | 0 |
| 1 | 1 | 1 | 0 | 0 | 0 |

FIG. 6A

M11(PM1)

| R | G | B | R | G | B |
|---|---|---|---|---|---|
| 1 | 0 | 1 | 0 | 1 | 0 |
| 1 | 0 | 1 | 0 | 1 | 0 |

M12(PM1)

| R | G | B | R | G | B |
|---|---|---|---|---|---|
| 1 | 1 | 2 | 2 | 0 | 0 |
| 2 | 1 | 1 | 2 | 2 | 0 |

FIG. 6B

M11(PM2)

| R | G | B | R | G | B |
|---|---|---|---|---|---|
| 1 | 0 | 1 | 0 | 1 | 0 |
| 1 | 0 | 1 | 0 | 1 | 0 |

M12(PM2)

| R | G | B | R | G | B |
|---|---|---|---|---|---|
| 1 | 1 | 1 | 0 | 0 | 0 |
| 1 | 1 | 1 | 0 | 0 | 0 |

FIG. 8A

100

| R | G | B | R | G | B | R | G | B | R | G | B | |
|---|---|---|---|---|---|---|---|---|---|---|---|---|
| + | − | + | − | + | − | + | − | + | − | + | − | |
| + | − | + | − | + | − | + | − | + | − | + | − | |
| + | − | + | − | + | − | + | − | + | − | + | − | ... |
| + | − | + | − | + | − | + | − | + | − | + | − | |
| | | | | | | | | | | | | |

⋮

FIG. 8B

100

| R | G | B | R | G | B | R | G | B | R | G | B | |
|---|---|---|---|---|---|---|---|---|---|---|---|---|
| + | + | + | + | + | + | − | − | − | − | − | − | |
| + | + | + | + | + | + | − | − | − | − | − | − | |
| + | + | + | + | + | + | − | − | − | − | − | − | ... |
| + | + | + | + | + | + | − | − | − | − | − | − | |
| | | | | | | | | | | | | |

⋮

TIMING CONTROLLER, DISPLAY APPARATUS HAVING THE SAME AND METHOD OF DRIVING THE DISPLAY APPARATUS

CROSS-REFERENCE TO RELATED APPLICATION

This application claims priority under 35 U.S.C. § 119 from, and the benefit of, Korean Patent Application No. 10-2015-0137408, filed on Sep. 30, 2015 in the Korean Intellectual Property Office (KIPO), the contents of which are herein incorporated by reference in their entirety.

BACKGROUND

1. Technical Field

Exemplary embodiments of the present inventive concept are directed to display devices, and more particularly to timing controllers, display apparatuses including the timing controllers and methods of driving the display apparatuses.

2. Discussion of the Related Art

In general, a liquid crystal display ("LCD") apparatus includes a first substrate that includes a pixel electrode, a second substrate that includes a common electrode, and a liquid crystal layer disposed between the first and second substrate. An electric field is generated by voltages applied to the pixel electrode and the common electrode. By adjusting an intensity of the electric field, a transmittance of light passing through the liquid crystal layer can be adjusted so that a desired image can be displayed.

In general, a liquid display apparatus includes a display panel and a panel driver. The display panel includes a plurality of gate lines, a plurality of data lines and a plurality of pixels connected to the gate lines and the data lines. The panel driver includes a gate driver that provides gate signals to the gate lines and a data driver that provides data voltages to the data lines.

SUMMARY

Exemplary embodiments of the present inventive concept can provide a timing controller capable of improving display quality.

Exemplary embodiments of the present inventive concept can provide a display apparatus that includes the timing controller.

Exemplary embodiments of the present inventive concept can provide a method of driving the display apparatus.

A timing controller according to an exemplary embodiment of the present inventive concept includes a data grouping part configured to generate a plurality of grayscale groups based on input image data, each grayscale group including n×m grayscales where n and m are natural numbers, a grayscale classifying part configured to generate a plurality of first grayscale patterns that respectively correspond to the grayscale groups, a grayscale in one of the grayscale groups being classified in the first grayscale patterns as a first grayscale if the grayscale is higher than a first reference grayscale or as a second grayscale if the grayscale is lower than a second reference grayscale, a pattern comparing part configured to compare each first grayscale pattern with a first pattern that includes the n×m first and second grayscales, a pattern counter configured to count a first number of patterns of the first grayscale patterns that are substantially the same as the first pattern, and a driving mode changing part configured to change a driving mode of a display panel when the first number is greater than a reference number.

In an exemplary embodiment, the grayscale classifying part can be configured to generate a plurality of second grayscale patterns that respectively correspond to the grayscale groups, a grayscale in one of the grayscale groups being classified in the second grayscale patterns as the first grayscale if the grayscale is higher than a third reference grayscale or as the second grayscale if the grayscale is lower than a fourth reference grayscale, where the third reference grayscale is higher than the fourth reference grayscale. The pattern comparing part can be configured to compare each second grayscale pattern with a second pattern different from the first pattern and that includes the n×m first and second grayscales. The pattern counter can be configured to count a second number of patterns of the second grayscale patterns that are substantially the same as the second pattern. The driving mode changing part can be configured to change the driving mode of the display panel when the second number is greater than the reference number.

In an exemplary embodiment, the pattern comparing part includes a pattern memory that stores the first and second patterns.

In an exemplary embodiment, the first reference grayscale is higher than the second reference grayscale. The grayscale classifying part can be configured to classify a grayscale in the grayscale groups that is between the first and second reference grayscales as a third grayscale. The pattern comparing part can be configured to determine that a pattern of the first grayscale patterns that includes the third grayscale pattern is not substantially the same as the first pattern.

In an exemplary embodiment, the pattern counter can be configured to count a second number of patterns of the first grayscale patterns that are organized as a horizontal line and are substantially the same as the first pattern to compare the second number with a second reference number.

In an exemplary embodiment, the pattern counter can be configured to count a number of horizontal lines in a frame where the second number is greater than the second reference number. The driving mode changing part can be configured to change the driving mode of the display panel when the number of the horizontal lines is greater than a frame reference number.

In an exemplary embodiment, the pattern counter can be configured to count a number of horizontal lines in a frame where the second number is greater than the second reference number to compare the number of the horizontal lines with a frame reference number, and can be configured to count a number of consecutive frames where the number of the horizontal lines is greater than the frame reference number. The driving mode changing part can be configured to change the driving mode of the display panel when the number of the consecutive frames is greater than a consecutive reference number.

In an exemplary embodiment, the driving mode changing can be configured to change a polarity inversion mode when the first number is greater than the reference number.

In an exemplary embodiment, the timing controller can further comprise a line memory that stores one horizontal line portion of the input image data.

A display apparatus according to an exemplary embodiment of the present inventive concept includes a display panel that includes a plurality of subpixels, and a timing controller that generates a plurality of grayscale groups based on input image data, generates a plurality of first grayscale patterns that respectively correspond to the grayscale groups, where a grayscale in the grayscale groups is classified in the first grayscale patterns as a first grayscale if the grayscale is higher than a first reference grayscale, or as a second grayscale if the grayscale is lower than a second reference grayscale, compares each first grayscale pattern with a first pattern that includes the first and second grayscales, counts a first number of patterns of the first grayscale patterns that are substantially the same as the first pattern, and changes a driving mode of the display panel when the first number is greater than a reference number.

In an exemplary embodiment, a subpixel configured to display a first color, a subpixel configured to display a second color and a subpixel configured to display a third color can be sequentially arranged in the display panel. The timing controller includes a driving mode changing part that changes the driving mode, and the driving mode changing part can be configured to change a polarity inversion mode when the first number is greater than the reference number.

In an exemplary embodiment, the driving mode changing part can be configured to change the polarity inversion mode to a six-dot-inversion mode when the first number is greater than the reference number.

In an exemplary embodiment, the driving mode changing part can be configured to maintain the polarity inversion mode as an one-dot-inversion mode when the first number is less than or equal to than the reference number.

A method of driving a display apparatus according to an exemplary embodiment of the present inventive concept includes generating a plurality of grayscale groups based on input image data, each grayscale group including n×m grayscales where n and m are natural numbers, generating a plurality of first grayscale patterns that respectively correspond to the grayscale groups, a grayscale in the grayscale groups being classified in the first grayscale patterns as a first grayscale if the grayscale is higher than a first reference grayscale or as a second grayscale when the grayscale is lower than a second reference grayscale, comparing each first grayscale pattern with a first pattern that includes the n×m first and second grayscales, counting a first number of patterns of the first grayscale patterns that are substantially the same as the first pattern, and changing a driving mode of the display panel when the first number is greater than a reference number.

In an exemplary embodiment, the method further comprises generating a plurality of second grayscale patterns that respectively correspond to the grayscale groups, a grayscale in the grayscale groups being classified in the second grayscale patterns as the first grayscale if the grayscale is higher than a third reference grayscale, or as the second grayscale if the grayscale is lower than a fourth reference grayscale, comparing each second grayscale pattern with a second pattern different from the first pattern and that includes the n×m first and second grayscales, counting a second number of patterns of the second grayscale patterns that are substantially the same as the second pattern, and changing the driving mode of the display panel when the second number is greater than the reference number.

In an exemplary embodiment, the first reference grayscale is higher than the second reference grayscale, and generating the first grayscale patterns can include classifying a grayscale in the grayscale groups that is between the first and second reference grayscales as a third grayscale. Comparing each of the first grayscale patterns can include determining that a pattern of the first grayscale patterns that includes the third grayscale pattern is not substantially the same as the first pattern.

In an exemplary embodiment, counting the first number can include counting a second number of patterns of the first grayscale patterns that are organized as a horizontal line and are substantially the same as the first pattern to compare the second number with a second reference number.

In an exemplary embodiment, counting the first number can further include counting a number of horizontal lines in a frame where the second number is greater than the second reference number. Changing the driving mode can include changing the driving mode of the display panel when the number of the horizontal lines is greater than a frame reference number.

In an exemplary embodiment, counting the first number may further include counting a number of horizontal lines in a frame where the second number is greater than the second reference number to compare the number of the horizontal lines with a frame reference number, and counting a number of consecutive frames where the number of the horizontal lines is greater than the frame reference number. Changing the driving mode can include changing the driving mode of the display panel when the number of the consecutive frames is greater than a consecutive reference number.

In an exemplary embodiment, changing the driving mode can include changing a polarity inversion mode of the display panel to a six-dot-inversion mode when the first number is greater than the reference number.

According to exemplary embodiments, grayscale groups are generated and are compared with error patterns, and a driving mode can be changed when the grayscale groups are substantially the same as the error patterns to prevent degradation of display quality. Thus, the display quality of the display panel can be improved.

BRIEF DESCRIPTION OF THE DRAWINGS

FIG. 4 illustrates grayscales displayed on a display panel included in a display apparatus according to exemplary embodiments.

FIG. 5 illustrates reference patterns stored in a display apparatus according to exemplary embodiments.

FIGS. 6A and 6B illustrate classified patterns according to exemplary embodiments.

FIGS. 8A and 8B illustrate a display panel included in a display apparatus according to exemplary embodiments.

DETAILED DESCRIPTION OF EXEMPLARY EMBODIMENTS

Hereinafter, exemplary embodiments of the present inventive concept will be described in detail with reference to the accompanying drawings.

Figure 1:
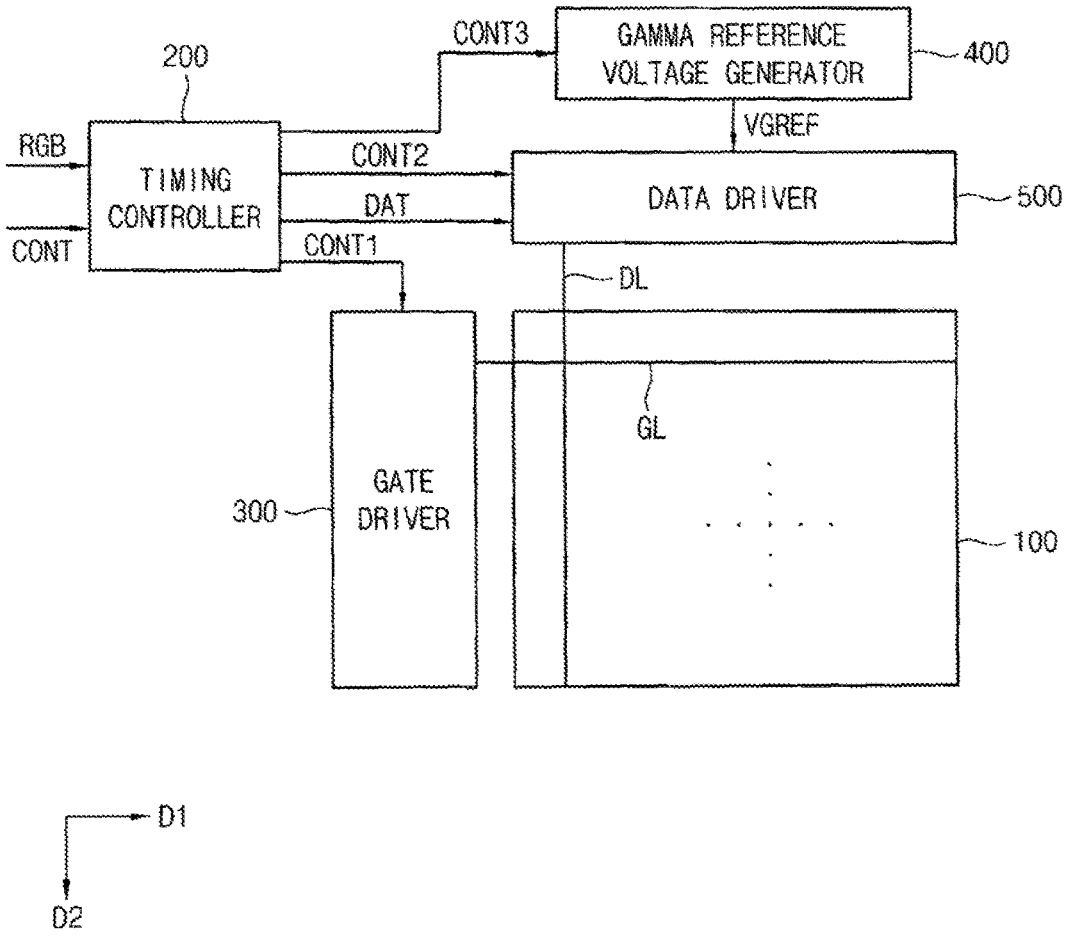
FIG. 1 is a block diagram that illustrates a display apparatus according to exemplary embodiments.

FIG. 1 is a block diagram illustrating a display apparatus according to exemplary embodiments.

Referring to FIG. 1, a display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region adjacent to the display region.

The display panel 100 includes a plurality of gate lines GL, a plurality of data lines DL and a plurality of subpixels electrically connected to the gate lines GL and the data lines DL. The gate lines GL extend in a first direction D1 and the data lines DL extend in a second direction D2 crossing the first direction D1.

In some exemplary embodiments, the subpixels include a switching element, a liquid crystal capacitor and a storage capacitor. The liquid crystal capacitor and the storage capacitor are electrically connected to the switching element. The subpixels may be arranged in a matrix configuration.

The display panel 100 will be described in detail with reference to FIG. 3.

The timing controller 200 receives input image data RGB and an input control signal CONT from an external device. In some exemplary embodiments, the input image data RGB includes red image data R, green image data G and blue image data B. The input control signal CONT includes a master clock signal and a data enable signal. The input control signal CONT further includes a vertical synchronizing signal and a horizontal synchronizing signal.

According to embodiments, the timing controller 200 generates a first control signal CONT1, a second control signal CONT2, a third control signal CONT3 and a data signal DAT based on the input image data RGB and the input control signal CONT.

According to embodiments, the timing controller 200 generates the first control signal CONT1 to control operations of the gate driver 300 based on the input control signal CONT, and outputs the first control signal CONT1 to the gate driver 300. The first control signal CONT1 includes a vertical start signal and a gate clock signal.

According to embodiments, the timing controller 200 generates the second control signal CONT2 to control operations of the data driver 500 based on the input control signal CONT, and outputs the second control signal CONT2 to the data driver 500. The second control signal CONT2 includes a horizontal start signal and a load signal.

According to embodiments, the timing controller 200 generates the data signal DAT based on the input image data RGB. The timing controller 200 outputs the data signal DAT to the data driver 500.

According to embodiments, the timing controller 200 generates the third control signal CONT3 to control operations of the gamma reference voltage generator 400 based on the input control signal CONT, and outputs the third control signal CONT3 to the gamma reference voltage generator 400.

The operations of the timing controller 200 will be described in detail with reference to FIGS. 2A and 2B.

According to embodiments, the gate driver 300 generates gate signals to drive the gate lines GL in response to the first control signal CONT1 received from the timing controller 200. The gate driver 300 sequentially outputs the gate signals to the gate lines GL.

In some exemplary embodiments, the gate driver 300 may be directly mounted on the display panel 100, or may be connected to the display panel 100 as a tape carrier package (TCP) type. Alternatively, the gate driver 300 may be integrated into the peripheral region of the display panel 100.

According to embodiments, the gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of pixel data included in the data signal DAT.

In some exemplary embodiments, the gamma reference voltage generator 400 may be disposed in the timing controller 200, or may be disposed in the data driver 500.

According to embodiments, the data driver 500 receives the second control signal CONT2 and the data signal DAT from the timing controller 200, and receives the gamma reference voltage VGREF from the gamma reference voltage generator 400. The data driver 500 converts the data signal DAT into analog data voltages based on the gamma reference voltage VGREF. The data driver 500 outputs the data voltages to the data lines DL.

In some exemplary embodiments, the data driver 500 may be directly mounted on the display panel 100, or may be connected to the display panel 100 as a tape carrier package (TCP) type. Alternatively, the data driver 500 may be integrated into the peripheral region of the display panel 100.

Figure 2A:
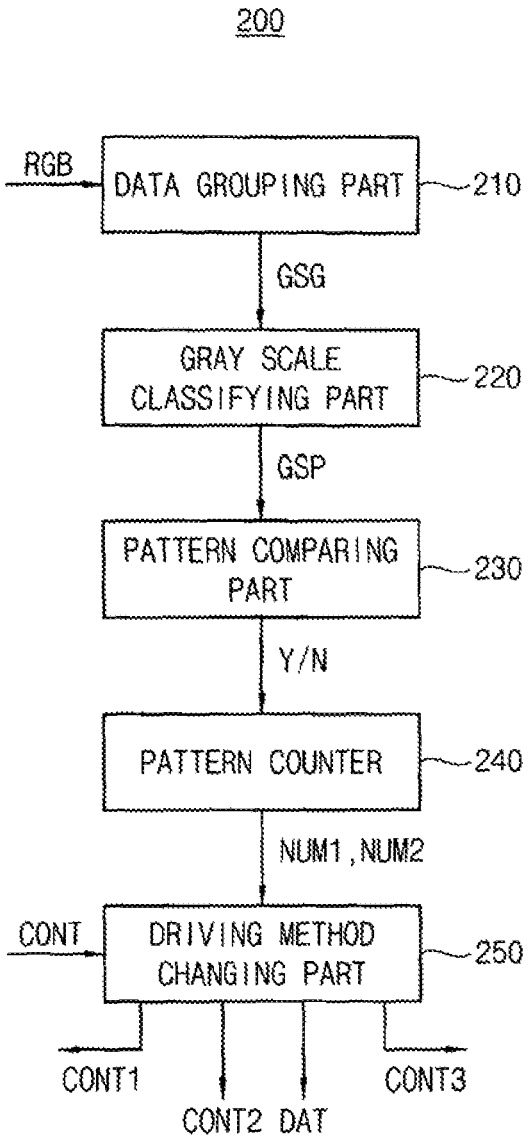
FIGS. 2A and 2B are block diagrams that illustrate examples of a timing controller according to exemplary embodiments.
Figure 2B:
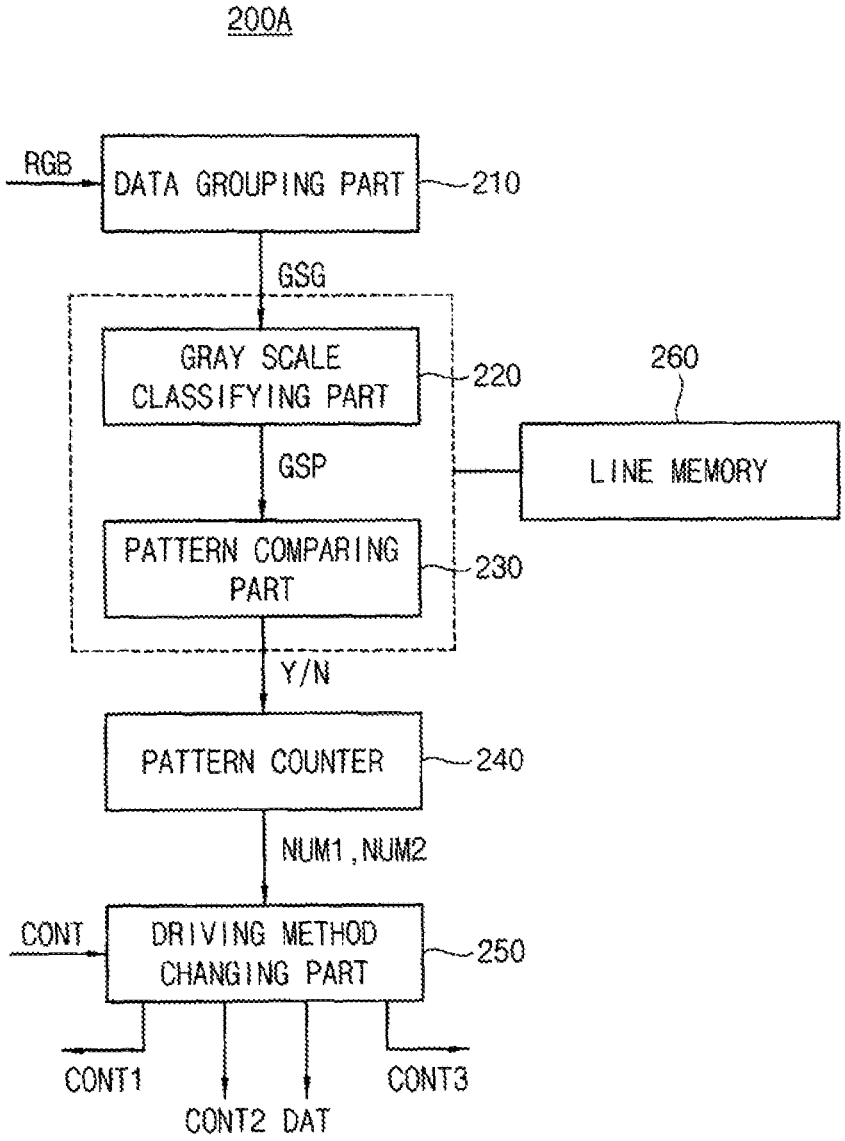

FIGS. 2A and 2B are block diagrams that illustrate examples of a timing controller according to exemplary embodiments.

Referring to FIGS. 1 and 2A, the timing controller 200 includes a data grouping part 210, a grayscale classifying part 220, a pattern comparing part 230, a pattern counter 240 and a driving method changing part 250.

According to embodiments, the data grouping part 210 generates a plurality of grayscale groups GSG based on the input image data RGB. Each of the grayscale groups GSG includes n×m grayscales, where n and m are natural numbers. The data grouping part 210 outputs the grayscale groups GSG to the grayscale classifying part 220.

According to embodiments, the grayscale classifying part 220 classifies a grayscale in the grayscale groups GSG that is higher than a first reference grayscale as a first grayscale, and a grayscale in the grayscale groups GSG that is lower than a second reference grayscale as a second grayscale. The second reference grayscale is less than the first reference grayscale. The grayscale classifying part 220 generates a plurality of first grayscale patterns GSP that respectively correspond to the grayscale groups GSG. The grayscale classifying part 220 classifies a grayscale in the grayscale groups GSG that is between the first and second reference grayscales as a third grayscale. The grayscale classifying part 220 classifies a grayscale in the grayscale groups GSG that is higher than a third reference grayscale as the first grayscale, and a grayscale in the grayscale groups GSG that is lower than a fourth reference grayscale as the second grayscale. The fourth reference grayscale is less than the third reference grayscale. The grayscale classifying part 220 generates a plurality of second grayscale patterns GSP that respectively correspond to the grayscale groups GSG. The grayscale classifying part 220 classifies a grayscale in the grayscale groups GSG that is between the third and fourth reference grayscales as the third grayscale. The grayscale classifying part 220 outputs the first and second grayscale patterns GSP to the pattern comparing part 230.

According to embodiments, the pattern comparing part 230 compares each of the first grayscale patterns GSP with a first pattern that includes the n×m first and second grayscales. The pattern comparing part 230 compares each of the second grayscale patterns GSP with a second pattern that includes the n×m first and second grayscales. The second pattern is different from the first pattern. The pattern comparing part 230 can determine whether or not a pattern in the first grayscale patterns GSP that includes the third grayscale is substantially the same as the first and second patterns. The pattern comparing part 230 may include a pattern memory for storing the first and second patterns. The pattern comparing part 230 outputs a determination result Y/N to the pattern counter 240.

According to embodiments, the pattern counter 240 counts a first number NUM1 of patterns of the first grayscale patterns GSP that are substantially the same as the first pattern. The pattern counter 240 counts a number of patterns of the first grayscale patterns GSP that are organized into a horizontal line and are substantially the same as the first pattern to compare the number of the patterns with a horizontal line reference number. The pattern counter 240 counts a number of horizontal lines organized into a frame where the number of the patterns is greater than the horizontal line reference number to compare the number of the horizontal lines with a frame reference number. The pattern counter 240 counts a number of consecutive frames where the number of the horizontal lines is greater than the frame reference number.

According to embodiments, the pattern counter 240 counts a second number NUM2 of patterns of the second grayscale patterns GSP that are substantially the same as the second pattern. The pattern counter 240 counts a number of patterns of the second grayscale patterns GSP that are organized into a horizontal line and are substantially the same as the second pattern to compare the number of the patterns with a horizontal line reference number. The pattern counter 240 counts a number of horizontal lines organized into a frame where the number of the patterns is greater than the horizontal line reference number to compare the number of the horizontal lines with a frame reference number. The pattern counter 240 counts a number of consecutive frames where the number of the horizontal lines is greater than the frame reference number.

The pattern counter 240 outputs the first and second numbers NUM1 and NUM2 to the driving method changing part 250.

The driving method changing part 250 may also be referred to as a driving mode changing part. According to embodiments, the driving method changing part 250 receives the input control signal CONT from an external device. The driving method changing part 250 receives the first and second numbers NUM1 and NUM2 from the pattern counter 240. The driving method changing part 250 changes a driving mode when the first number NUM1 is greater than the reference number. The driving method changing part 250 may change a polarity inversion mode when the first number NUM1 is greater than the reference number. The driving method changing part 250 changes the driving mode when the second number NUM2 is greater than the reference number. The driving method changing part 250 may change the polarity inversion mode when the second number NUM2 is greater than the reference number. The driving method changing part 250 generates the second control signal CONT2 and the data signal DAT based on the input control signal CONT and the changed driving mode or the changed polarity inversion mode. The driving method changing part 250 generates the first control signal CONT1 and the third control signal CONT3 based on the input control signal CONT. The driving method changing part 250 outputs the first control signal CONT1 to the gate driver 300. The driving method changing part 250 outputs the second control signal CONT2 and the data signal DAT to the data driver 500. The driving method changing part 250 outputs the third control signal CONT3 to the gamma reference voltage generator 400.

According to embodiments, referring to FIGS. 1, 2A and 2B, the timing controller 200 may further include a line memory 260.

The data grouping part 210 generates the grayscale groups GSG based on the input image data RGB. Each of the grayscale groups GSG may include 2×m grayscales. In this case, the line memory 260 stores one horizontal line portion of the input image data RGB.

Any repetitive explanation concerning FIG. 2A will be omitted.

Figure 3:
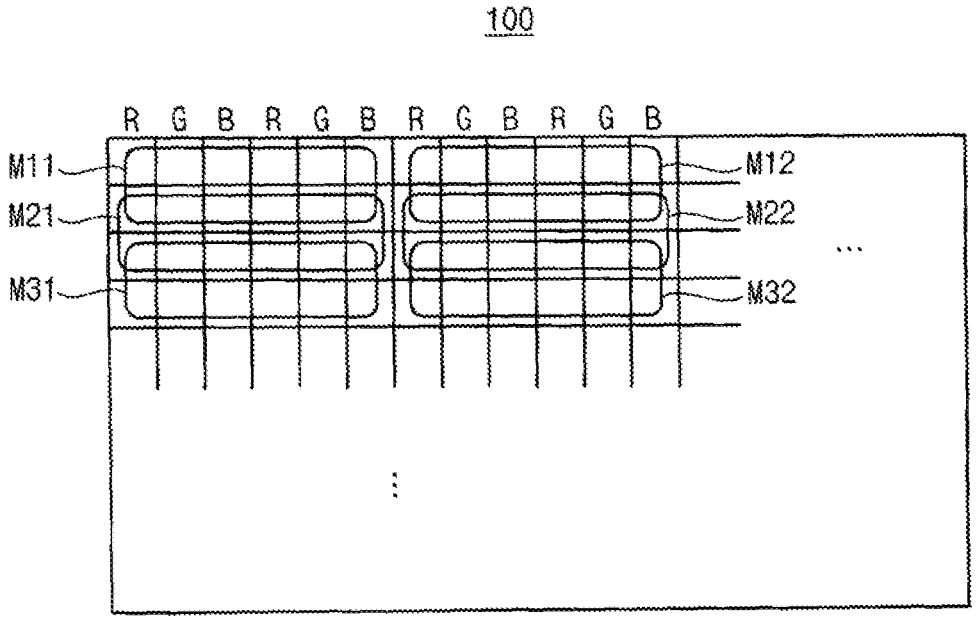
FIG. 3 illustrates a display panel included in a display apparatus according to exemplary embodiments.

FIG. 3 illustrates a display panel included in a display apparatus according to exemplary embodiments.

Referring to FIGS. 1, 2A, 2B and 3, the display panel 100 includes subpixels. According to embodiments, a subpixel that displays a first color R, a subpixel that displays a second color G, and a subpixel that displays a third color B are sequentially arranged in the display panel 100. The first color R is red. The second color G is green. The third color B is blue.

According to embodiments, the data grouping part 210 generates a plurality of grayscale groups M11, M21, M31, M12, M22, M32. Each of the grayscale groups M11, M21, M31, M12, M22, M32 includes 2×6 subpixels.

FIG. 4 illustrates grayscales displayed on a display panel included in a display apparatus according to exemplary embodiments. FIG. 5 illustrates reference patterns stored in a display apparatus according to exemplary embodiments. FIGS. 6A and 6B illustrate classification patterns according to exemplary embodiments.

In FIG. 5, a first reference grayscale of a first pattern PM1 is 200, and a second reference grayscale of the first pattern PM1 is 50, and a third reference grayscale of a second pattern PM2 is 180, and a fourth reference grayscale of a second pattern PM2 is 80.

Referring to FIGS. 1, 2A, 2B, 3 through 5 and 6A, according to embodiments, the grayscale classifying part 220 classifies a grayscale in a first grayscale group M11 that is higher than the first reference grayscale as a first grayscale 1, and a grayscale in the first grayscale group M11 that is lower than the second reference grayscale as a second grayscale 0. The grayscale classifying part 220 generates a first grayscale pattern M11 (PM1) corresponding to the first grayscale group M11 based on the classification. The grayscale classifying part 220 classifies a grayscale in the first grayscale group M11 that is between the first and second reference grayscales as a third grayscale 2. The grayscale classifying part 220 classifies a grayscale in a second grayscale group M12 that is higher than the first reference grayscale as the first grayscale 1, and a grayscale in the second grayscale group M12 that is lower than the second reference grayscale as the second grayscale 0. The grayscale classifying part 220 generates another first grayscale pattern M12 (PM1) corresponding to the second grayscale group M12 based on the classification. The grayscale classifying part 220 classifies a grayscale in the second grayscale group M12 that is between the first and second reference grayscales as the third grayscale 2. The grayscale classifying part 220 outputs the first grayscale patterns M11(PM1), M12 (PM1) to the pattern comparing part 230.

According to embodiments, the pattern comparing part 230 compares each of the first grayscale patterns M11 (PM1), M12(PM1) with the first pattern PM1, which includes 2×6 first and second grayscales 1, 0. The pattern comparing part 230 can determine whether or not a pattern of the first grayscale patterns M11 (PM1), M12(PM1) that include the third grayscale 2 is substantially the same as the first pattern PM1. In FIG. 6A, one of the first grayscale patterns M11(PM1) is substantially the same as the first pattern PM1, and the other first grayscale pattern M12(PM1) is not substantially the same as the first pattern PM1. The pattern comparing part 230 outputs a determination result Y/N to the pattern counter 240.

Referring to FIGS. 1, 2A, 2B, 3 through 5 and 6B, according to embodiments, the grayscale classifying part 220 classifies a grayscale in a first grayscale group M11 that is higher than the third reference grayscale as a first grayscale 1, and a grayscale in the first grayscale group M11 that is lower than the fourth reference grayscale as a second grayscale 0. The grayscale classifying part 220 generates a second grayscale pattern M11(PM2) corresponding to the first grayscale group M11 based on the classification. The grayscale classifying part 220 classifies a grayscale in the first grayscale group M11 that is between the third and fourth reference grayscales as a third grayscale 2. The grayscale classifying part 220 classifies a grayscale in a second grayscale group M12 that is higher than the third reference grayscale as the first grayscale 1, and a grayscale in the second grayscale group M12 that is lower than the fourth reference grayscale as the second grayscale 0. The grayscale classifying part 220 generates another second grayscale pattern M12(PM2) corresponding to the second grayscale group M12 based on the classification. The grayscale classifying part 220 classifies a grayscale in the second grayscale group M12 between the third and fourth reference grayscales as the third grayscale 2. The grayscale classifying part 220 outputs the second grayscale patterns M11(PM2), M12(PM2) to the pattern comparing part 230.

According to embodiments, the pattern comparing part 230 compares each of the second grayscale patterns M11 (PM2), M12(PM2) with the second pattern PM2, which includes 2×6 first and second grayscales 1, 0. The pattern comparing part 230 can determine whether or not a pattern of the second grayscale patterns M11(PM2), M12(PM2) that include the third grayscale 2 is substantially the same as the second pattern PM2. In FIG. 6B, one of the second grayscale patterns M11(PM2) is not substantially the same as the second pattern PM2, and the other second grayscale pattern M12(PM2) is substantially the same as the second pattern PM2. The pattern comparing part 230 outputs a determination result Y/N to the pattern counter 240.

Figure 7A:
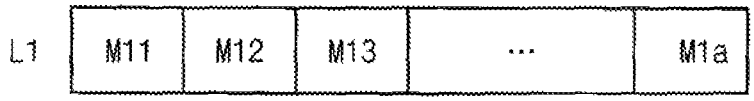
FIGS. 7A, 7B and 7C illustrate a pattern counting process of a timing controller according to exemplary embodiments.
Figure 7B:
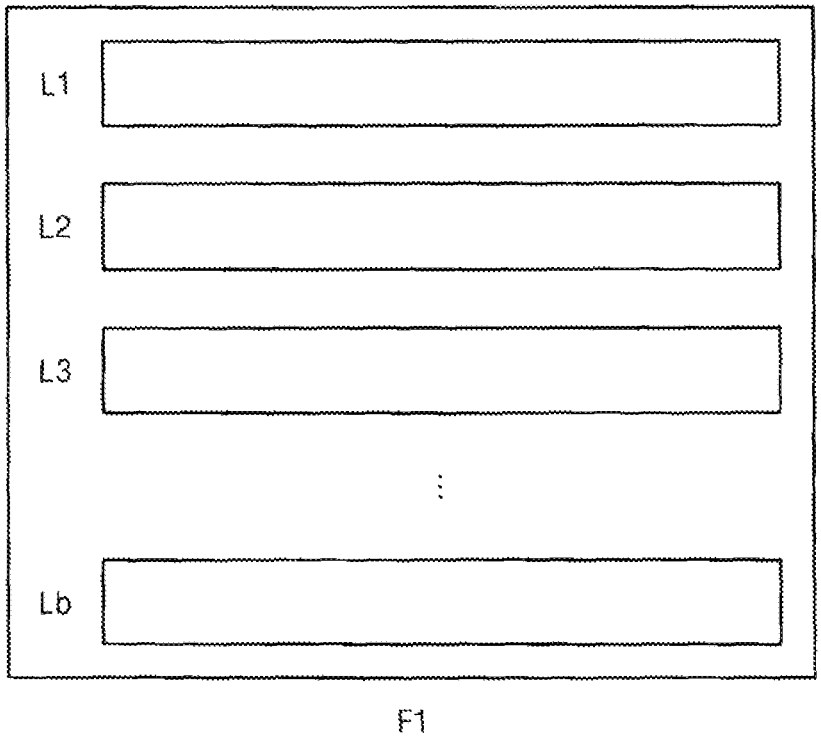
Figure 7C:
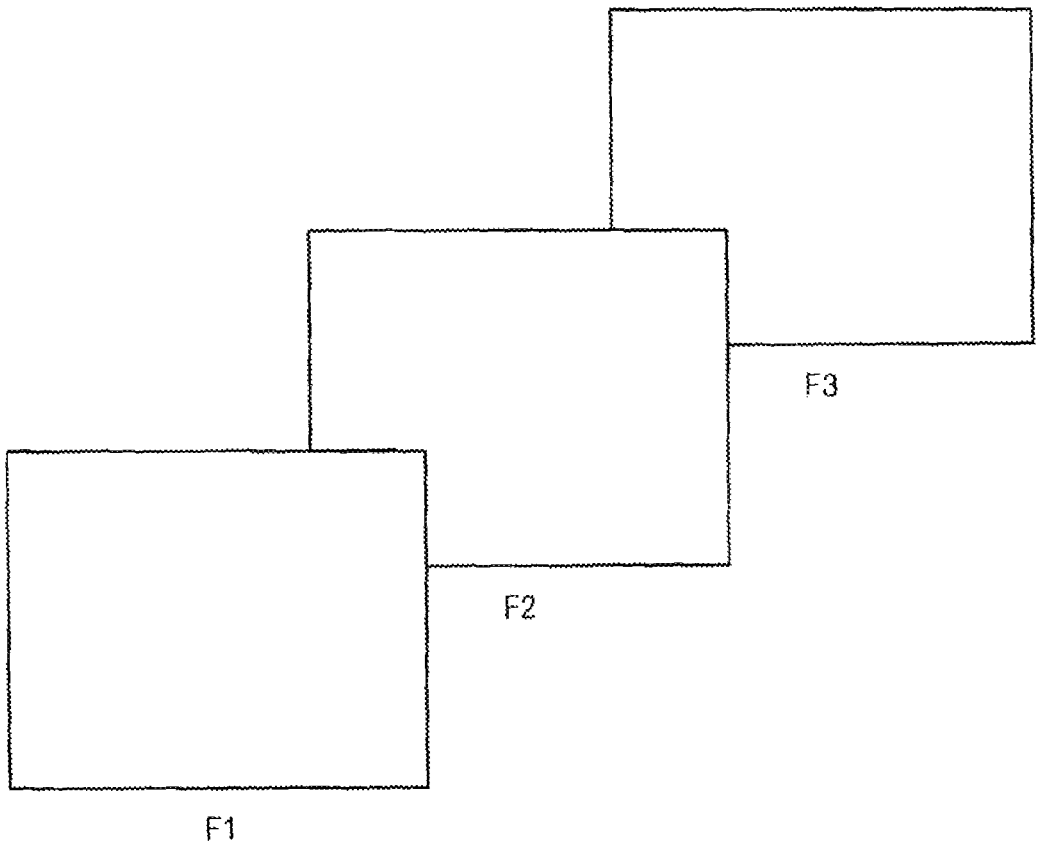

FIGS. 7A, 7B and 7C illustrate a pattern counting process of a timing controller according to exemplary embodiments.

According to embodiments, referring to FIGS. 1, 2A, 2B, 3 through 5, 6A, 6B and 7A through 7C, the first grayscale patterns M11(PM1), M12(PM1), . . . , are organized into a horizontal line L1, and the pattern counter 240 counts a first number of patterns of the first grayscale patterns M11(PM1), M12(PM1), . . . , that are substantially the same as the first pattern PM1 to compare the first number with a horizontal line reference number.

According to embodiments, a plurality of lines L1, L2, L3, . . . , Lb of the first grayscale patterns are organized into a frame F1. The pattern counter 240 counts a second number of horizontal lines where the first number is greater than the horizontal line reference number to compare the second number with a frame reference number.

According to embodiments, the pattern counter 240 counts a number of consecutive frames F1, F2, F3, . . . where the second number is greater than the frame reference number.

According to embodiments, the second grayscale patterns M11(PM2), M12(PM2), . . . , are organized into a horizontal line L1, and the pattern counter 240 counts a third number of patterns of the second grayscale patterns M11(PM2), M12(PM2), . . . , that are substantially the same as the second pattern PM2 to compare the third number with the horizontal line reference number.

According to embodiments, a plurality of lines L1, L2, L3, . . . , Lb of the first grayscale patterns are organized into a frame F1. The pattern counter 240 counts a fourth number of horizontal lines where the third number is greater than the horizontal line reference number to compare the fourth number with the frame reference number.

According to embodiments, the pattern counter 240 counts a number of consecutive frames F1, F2, F3, . . . where the fourth number is greater than the frame reference number.

According to embodiments, pattern counter 240 outputs the second and fourth numbers or the number of the consecutive frames to the driving method changing part 250.

FIGS. 8A and 8B illustrate a display panel included in a display apparatus according to exemplary embodiments.

According to embodiments, referring to FIGS. 1, 2A, 2B, 3 through 5, 6A, 6B, 7A through 7C, 8A and 8B, the driving method changing part 250 changes a polarity inversion mode when the second number is greater than the frame reference number, or when the fourth number is greater than the frame reference number, or when the number of the consecutive frames is greater than a consecutive reference number. For example, the driving method changing part 250 can change the polarity inversion mode to a six-dot-inversion mode illustrated in FIG. 8B when the second number is greater than the frame reference number, when the fourth number is greater than the frame reference number, or when the number of the consecutive frames is greater than the consecutive reference number. The driving method changing part 250 can maintain the polarity inversion mode as a one-dot-inversion mode illustrated in FIG. 8A when the second number is less than or equal to the frame reference number, when the fourth number is less than or equal to the frame reference number, and when the number of the consecutive frames is less than or equal to the consecutive reference number.

Figure 9:
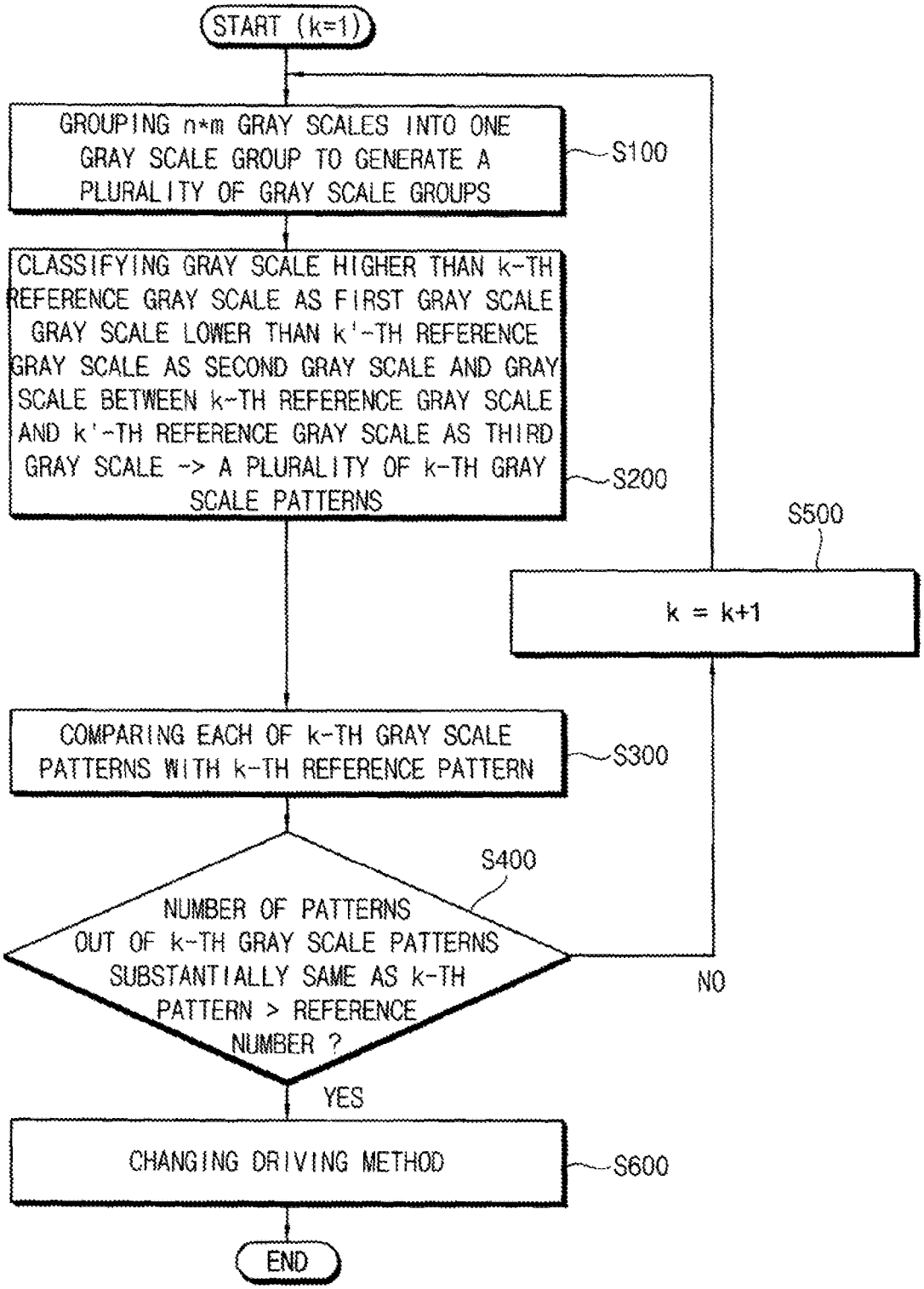
FIG. 9 is a flow chart that illustrates a method of driving display apparatus according to exemplary embodiments.

FIG. 9 is a flow chart that illustrates a method of driving a display apparatus according to exemplary embodiments. Any repetitive explanation concerning FIGS. 1, 2A, 2B, 3 through 5, 6A, 6B, 7A through 7C, 8A and 8B will be omitted.

Referring now to FIG. 9, a method starts, with a counter k initialized to 1, at step S100, by grouping n×m gray scales into one gray scale group to generate a plurality of gray scale groups. At step S200, gray scales higher than a k-th reference gray scale are classified as first gray scales, gray scales lower than the k'-th reference gray scale are classified as second gray scales, where k' is less than k, and gray scales between the k-th reference gray scale and the k'-th reference gray scale are classified as third gray scales, to generate a plurality of k-th gray scale patterns. At step S300, each of the k-th gray scale patterns is compared with a k-th reference pattern, to determine the number of patterns of the k-th gray scale patterns that are substantially the same as k-th reference pattern. At step S400, if the number of patterns of the k-th gray scale patterns that are substantially the same as k-th reference pattern is greater than a reference number, the driving method id changed, at step S600. If not, the counter k is incremented by one at step S500, and control loops back to step S100, and steps S100, S200, S300, and S400 are repeated.

The above described embodiments can be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a display panel that includes a plurality of subpixels; and a timing controller configured to generate a plurality of grayscale groups based on input image data, generate a plurality of first grayscale patterns that respectively correspond to the grayscale groups, wherein a grayscale in the grayscale groups is classified in the first grayscale patterns as a first grayscale if the grayscale is higher than a first reference grayscale or as a second grayscale if the grayscale is lower than a second. reference grayscale, compare each first grayscale pattern with a first pattern that includes the first and second grayscales, count a first number of patterns of the first grayscale patterns that are substantially the same as the first pattern; and change a driving mode of the display panel when the first number is greater than a reference number, wherein the first reference grayscale is higher than the second reference grayscale, wherein a grayscale in the grayscale groups that is between the first and second reference grayscales is classified as a third grayscale, and wherein a pattern of the first grayscale patterns that includes the third grayscale is determined not to be substantially the same as the first pattern.

2. The display apparatus of claim 1, wherein a subpixel configured to display a first color, a subpixel configured to display a second color and a subpixel configured to display a third color are sequentially arranged in the display panel, and wherein the timing controller includes a driving mode changing part that changes the driving mode, wherein the driving mode changing part is configured to change a polarity inversion mode when the first number is greater than the reference number.

3. The display apparatus of claim 2, wherein the driving mode changing part is configured to change the polarity inversion mode to a six-dot-inversion mode when the first number is greater than the reference number.

4. The display apparatus of claim 2, wherein the driving mode changing part is configured to maintain the polarity inversion mode as a one-dot-inversion mode when the first number is less than or equal to the reference number.

5. The display apparatus of claim 1, wherein a plurality of second grayscale patterns that respectively correspond to the grayscale groups are generated, and a grayscale in one of the grayscale groups is classified in the second grayscale patterns as the first grayscale if the grayscale is higher than a third reference grayscale or as the second grayscale if the grayscale is lower than a fourth reference grayscale, wherein the third reference grayscale is higher than the fourth reference grayscale, wherein each second grayscale pattern is compared with a second pattern different from the first pattern and that includes the n×m first and second grayscales, wherein a second number of patterns of the second grayscale patterns that are substantially the same as the second pattern are counted, and wherein the driving mode of the display panel is changed when the second number is greater than the reference number.

6. The display apparatus of claim 5, wherein timing controller includes a pattern memory that stores the first and second patterns.

7. The display apparatus of claim 1, wherein a second number of patterns of the first grayscale patterns that are organized as a horizontal line and are substantially the same as the first pattern are counted to compare the second number with a second reference number.

8. The display apparatus of claim 7, wherein a number of horizontal lines in a frame where the second number is greater than the second reference number are counted, and wherein the driving mode of the display panel is changed when the number of horizontal lines is greater than a frame reference number.

9. The display apparatus of claim 7, wherein a number of horizontal lines in a frame where the second number is greater than the second reference number are counted to compare the number of horizontal tines with a frame reference number, and a number of consecutive frames where the number of horizontal lines is greater than the frame reference number are counted, and wherein the driving mode of the display panel is changed when the number of consecutive frames is greater than a consecutive reference number.

10. The display apparatus of claim 1, wherein a polarity inversion mode of the display panel is changed when the first number is greater than the reference number.

11. The display apparatus of claim 1, wherein the timing controller comprises:

a line memory that stores storing one horizontal line portion of the input image data.

12. A method of driving a display apparatus, the method comprising:

generating a plurality of grayscale groups based on input image data, each grayscale group including n×m grayscales where and m are natural numbers;

generating a plurality of first grayscale patterns that respectively correspond to the grayscale groups, a grayscale in the grayscale groups being classified in the first grayscale patterns as a first grayscale if the grayscale is higher than a first reference grayscale or as a second grayscale if the grayscale is lower than a second reference grayscale;

comparing each first grayscale pattern with a first pattern that includes the n×m first and second grayscales;

counting a first number of patterns of the first grayscale patterns that are substantially the same as the first pattern; and changing a driving mode of a display panel when. the first number is greater than a reference number, wherein the first reference grayscale is higher than the second reference grayscale, wherein generating the first grayscale patterns includes classifying a grayscale ire the grayscale groups that is between the first and second reference grayscales as a third grayscale, and wherein comparing each of the first grayscale patterns includes determining that a pattern of the first grayscale patterns that includes the third grayscale is not substantially the same as the first pattern.

13. The method of claim 12, further comprising:

generating a plurality of second grayscale patterns that respectively correspond to the grayscale groups, a grayscale in one of the grayscale groups being classified in the second grayscale patterns as the first grayscale if the grayscale is higher than a third reference grayscale or as the second grayscale if the grayscale is lower than a fourth reference grayscale, wherein the third reference grayscale is higher than the fourth reference grayscale;

comparing each second grayscale pattern with a second pattern different from the first pattern and that includes the n×m first and second grayscales;

counting a second number of patterns of the second grayscale patterns that are substantially the same as the second pattern; and changing the driving mode of the display panel when the second number is greater than the reference number.

14. The method of claim 12, wherein counting the first number includes counting a second number of patterns of the first grayscale patterns that are organized as a horizontal line and are substantially the same as the first pattern to compare the second number with a second reference number.

15. The method of claim 14, wherein counting the first number further includes counting a number of horizontal lines in a frame where the second number is greater than the second reference number, and wherein changing the driving mode includes changing the driving mode of the display panel when the number of horizontal lines is greater than a frame reference number.

16. The method of claim 14, wherein counting the first number further includes counting a number of horizontal lines in a frame where the second number is greater than the second reference number to compare the number of horizontal lines with a frame reference number, and counting a number of consecutive frames where the number of horizontal lines is greater than the frame reference number, and wherein changing the driving mode includes changing the driving mode of the display panel when the number of consecutive frames is greater than a consecutive reference number.

17. The method of claim 12, wherein changing the driving mode includes changing a polarity inversion mode of the display panel to a six-dot-inversion mode when the first number is greater than the reference number.

* * * * *